US009816268B1

(12) United States Patent
Inzeo et al.

(10) Patent No.: US 9,816,268 B1
(45) Date of Patent: Nov. 14, 2017

(54) METAL NAILER WITH ADJUSTABLE CURVATURE

(71) Applicants: Joseph A. Inzeo, West Allis, WI (US); Peter H. Kastner, Germantown, WI (US)

(72) Inventors: Joseph A. Inzeo, West Allis, WI (US); Peter H. Kastner, Germantown, WI (US)

( * ) Notice: Subject to any disclaimer, the term of this patent is extended or adjusted under 35 U.S.C. 154(b) by 0 days.

(21) Appl. No.: 15/430,863

(22) Filed: Feb. 13, 2017

(51) Int. Cl.
*E04B 2/00* (2006.01)
*E04B 2/62* (2006.01)

(52) U.S. Cl.
CPC ..... *E04B 2/62* (2013.01)

(58) Field of Classification Search
CPC .. E04H 12/00; E04H 1/24; E04B 2/62; E04G 11/06
See application file for complete search history.

(56) References Cited

U.S. PATENT DOCUMENTS 5,291,717 A * 3/1994 Turner ..... E04B 2/7457 52/247
6,094,877 A * 8/2000 White ..... E04B 2/82 52/245
6,237,301 B1 5/2001 Paradis
6,434,908 B1 * 8/2002 Ferrante ..... E04B 2/82 52/481.2
6,637,173 B1 * 10/2003 Wheeler ..... E04B 2/7457 52/241
7,293,392 B2 * 11/2007 Krumbacher ..... E04B 2/7457 403/103
7,458,188 B2 12/2008 Mears
8,276,335 B2 * 10/2012 Waibel ..... E04B 2/7453 52/241
8,453,403 B2 * 6/2013 Wheeler ..... E04B 9/06 52/241
8,621,823 B2 * 1/2014 Mears ..... E04F 13/0803 52/481.1

* cited by examiner

*Primary Examiner* — Beth Stephan
(74) *Attorney, Agent, or Firm* — Donald J. Ersler

(57) ABSTRACT

A metal nailer with adjustable curvature preferably includes an upper member and a lower member. The upper and lower members start as strips of material. A plurality of first openings are formed adjacent a first edge of each strip. A plurality of second openings are formed adjacent a second edge of each strip. A plurality of fastener openings are formed in the lower strip and a plurality of fastener clearance openings in the upper strip. An upward bent fold is formed in a center of each of the plurality of first and second openings. First and second edges of the strips are bent to form a U-shape. The upper member is inserted into the lower member. The upper and lower members are attached to each other with a plurality of fasteners. The metal nailer with adjustable curvature may be bent in horizontal and/or vertical planes.

20 Claims, 10 Drawing Sheets

METAL NAILER WITH ADJUSTABLE CURVATURE

BACKGROUND OF THE INVENTION

1. Field of the Invention

The present invention relates generally to building structures and more specifically to a metal nailer with adjustable curvature, which allows a curved coping or fascia system to be attached to an edge of a building.

2. Discussion of the Prior Art

U.S. Pat. No. 6,237,301 to Paradis discloses a flexible runner. U.S. Pat. No. 7,458,188 to Mears discloses a structural alignment member. However, neither of the above patents include attachment to both an upper and lower member.

Accordingly, there is a clearly felt need in the art for a metal nailer with adjustable curvature, which allows a coping or fascia system with a curve in horizontal and/or vertical planes to be attached to an edge of a building.

SUMMARY OF THE INVENTION

The present invention provides a metal nailer with adjustable curvature, which allows a curved coping or fascia system to be attached to a curved edge of a building. The metal nailer preferably includes an upper member and a lower member. The lower member includes a lower strip of material. A first plurality of lower openings are formed adjacent a first edge of the lower strip and a second plurality lower openings are formed adjacent a second edge of the lower strip. The plurality of first and second lower openings occur at a set distance from each other in a series. The plurality of first and second openings preferably have a rectangular shape, but other shapes could also be used. A fastener opening is formed in substantially a center of two adjacent first lower openings and two adjacent second lower openings. Two lower fastener openings are formed in opposing ends of each lower strip.

An upward bent fold with a 45 degree included angle is formed in a center of each first and second lower opening. However, other values of included angles may also be used. The upward bent fold includes a first sidewall bent strip a second sidewall bent strip and a base bent strip. A height of the first and second sidewall bent strips is less than half of a height of a first lower sidewall and a second lower sidewall. A height of the base bent strip is less than half of a height of the first and second lower sidewalls. A width of the base strip is greater than a width of the first or second lower openings. The first and second edges of the lower strip are bent at a substantially 90 degree angle relative to a middle portion of the lower strip to form a U-shape. The first lower sidewall, the second lower sidewall and a lower base portion are formed from the bending.

The upper member includes an upper strip of material. The upper member includes all the features of the lower member, except that the lower fastener openings are replaced with fastener clearance openings to allow a fastener to be installed with a tool. The upper member is inserted into the lower member, such that one of the first and second upper sidewalls are inserted between the first and second lower sidewalls and moved horizontally, such that the first and second upper sidewalls contact the first and second lower sidewalls. A plurality of fasteners, such as rivets or the like are used to secure the first upper sidewall to the first lower sidewall and the second lower sidewall to the second upper sidewall. The upper member allows fascia materials to be secured to a top surface thereof.

In use, the metal nailer may be bent into a curved orientation in a horizontal plane, a vertical plane, or in both horizontal and vertical planes. The metal nailer is attached to a work surface by inserting a plurality of fasteners through the plurality of lower fastener openings into the work surface.

Accordingly, it is an object of the present invention to provide a metal nailer with adjustable curvature, which allows a coping or fascia system with a curve in horizontal and/or vertical planes to be attached to an edge of a building.

These and additional objects, advantages, features and benefits of the present invention will become apparent from the following specification.

DETAILED DESCRIPTION OF THE PREFERRED EMBODIMENTS

Figure 1:
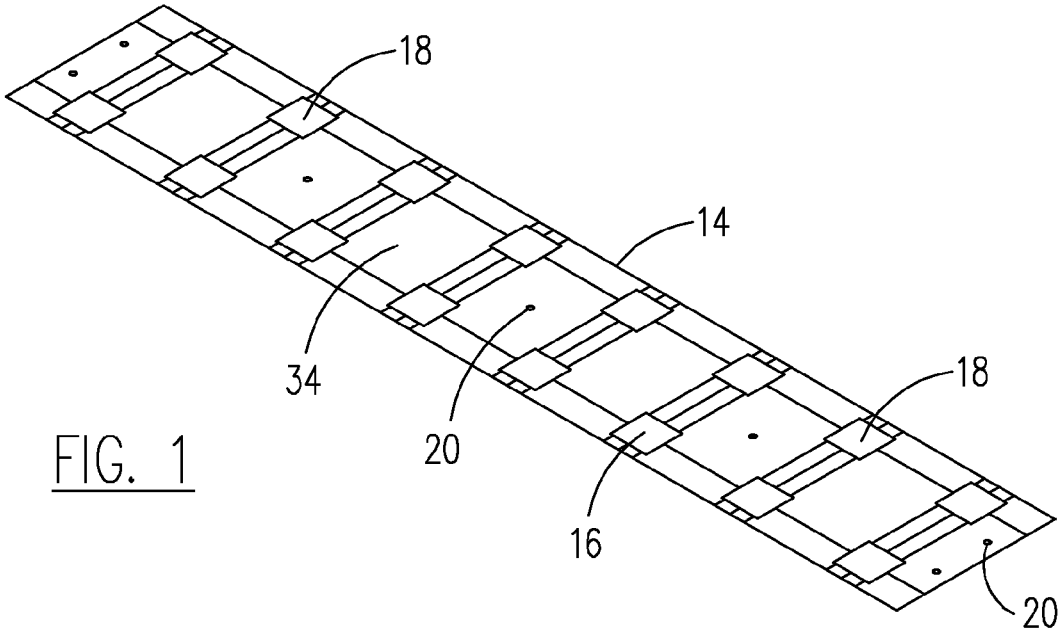
FIG. 1 is a perspective view of an unfolded lower member of a metal nailer with adjustable curvature in accordance with the present invention.
Figure 5:
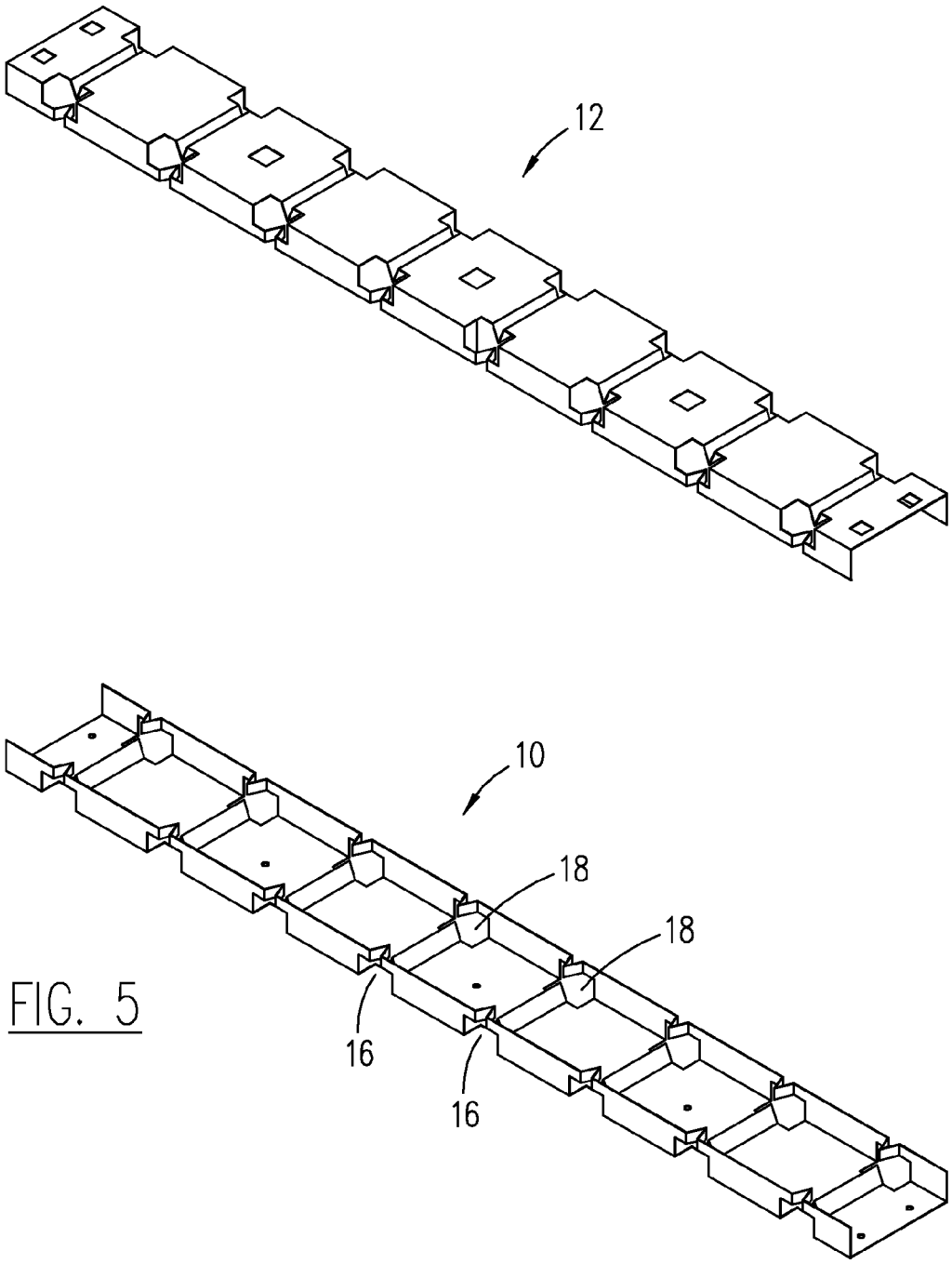
FIG. 5 is an exploded perspective view of metal nailer with adjustable curvature in accordance with the present invention.
Figure 9:
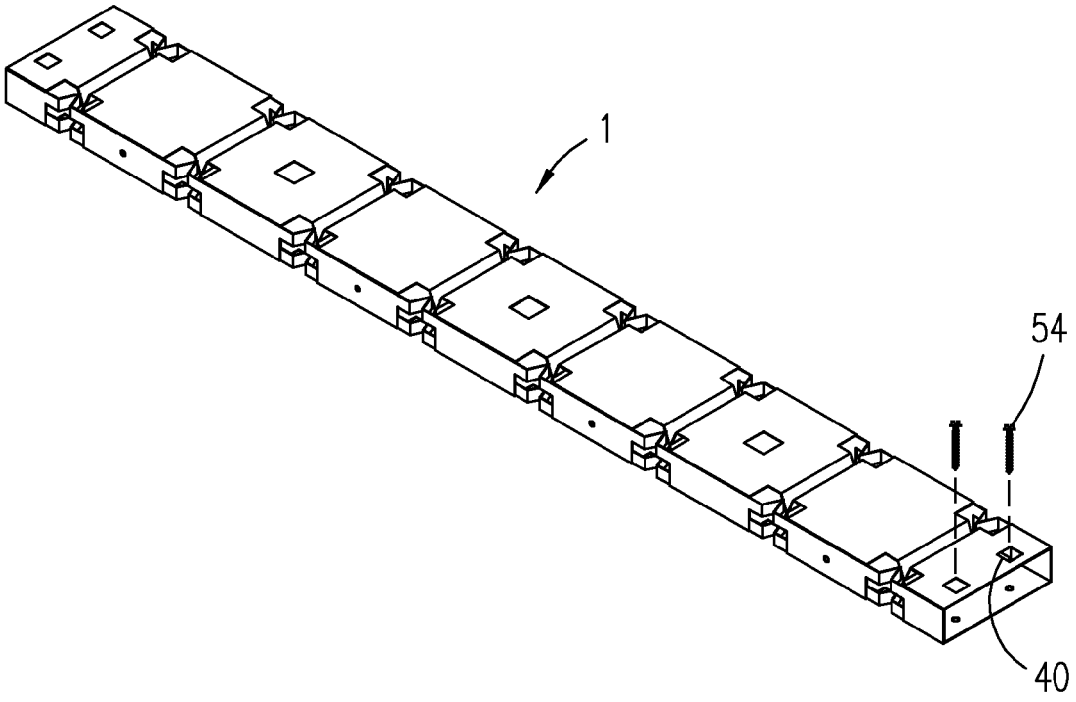
FIG. 9 is a perspective view of a metal nailer with adjustable curvature without bending in accordance with the present invention.

With reference now to the drawings, and particularly to FIG. 9, there is shown a perspective view of a metal nailer with adjustable curvature 1. With reference to FIG. 5, the metal nailer with adjustable curvature 1 preferably includes a lower member 10 and an upper member 12. With reference to FIG. 1, the lower member 10 includes a lower strip of material 14. A first plurality of lower openings 16 are formed adjacent a first edge of the lower strip and a second plurality lower openings 18 are formed adjacent a second edge of the lower strip 14. The plurality of first and second lower openings 16, 18 occur at a set distance from each other in a series. The plurality of first and second openings 16, 18 preferably have a rectangular shape, but other shapes could also be used. A fastener opening 20 is formed in substantially a center of two adjacent first lower openings 16 and two adjacent second lower openings 18. Two lower fastener openings 20 are formed in opposing ends of each lower strip 14.

Figure 3:
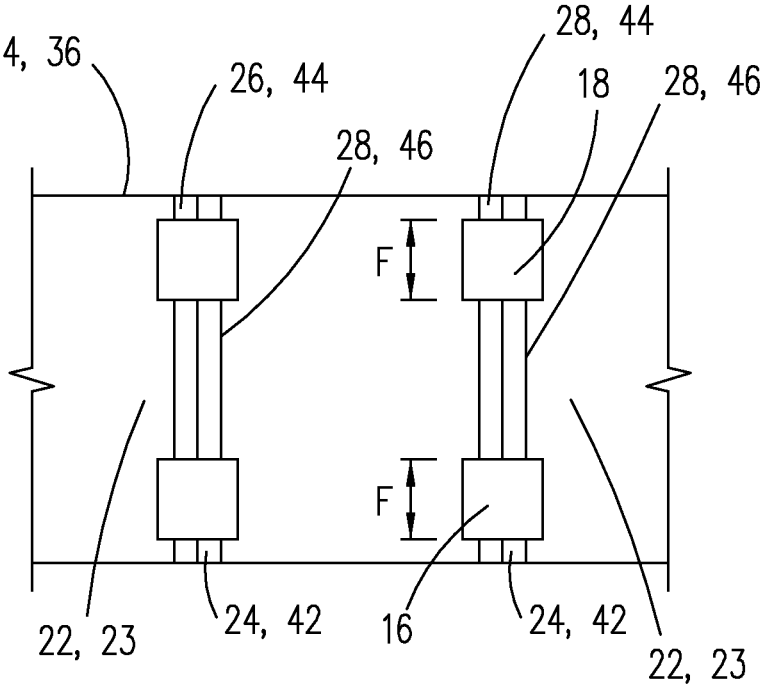
FIG. 3 is a partial top view of a lower or upper strip with two upward bent folds and without first and second lower sidewalls of a metal nailer with adjustable curvature in accordance with the present invention.
Figure 4:
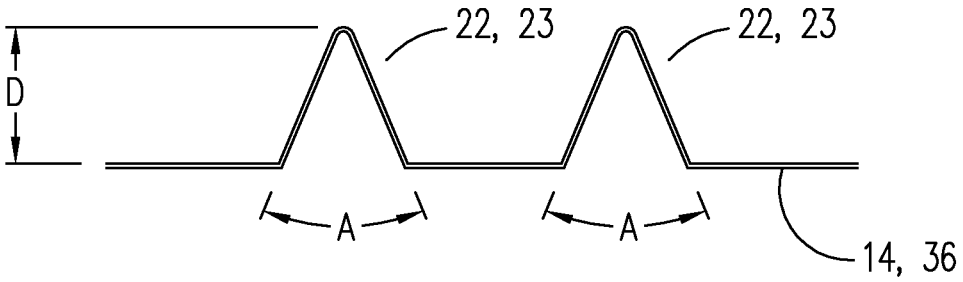
FIG. 4 is a partial side view of a lower or upper strip with two upward bent folds and without first and second lower sidewalls of a metal nailer with adjustable curvature in accordance with the present invention.
Figure 6:
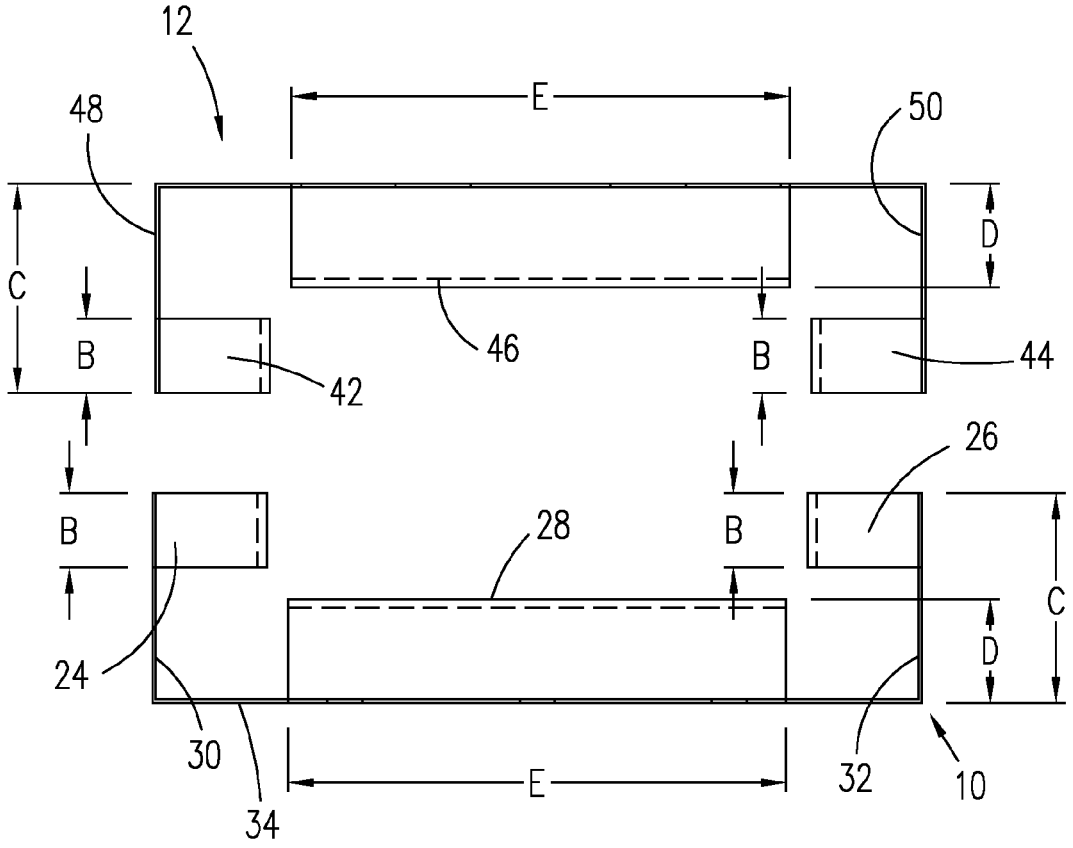
FIG. 6 is an exploded end view of metal nailer with adjustable curvature in accordance with the present invention.

With reference to FIGS. 3-4, an upward bent fold 22 preferably has an included angle "A," which is formed in a center of each first and second lower opening 16, 18. Angle "A" preferably has a value of 45 degrees. However, other values of included angles may also be used. The upward bent fold 22 includes a first sidewall bent strip 24, a second sidewall bent strip 26 and a base bent strip 28. With reference to FIG. 6, a bent height "B" of the first and second lower sidewall bent strips 24, 26 is less than half of a height "C" of a first lower sidewall 30 and a second lower sidewall 32. A height "D" of the base bent strip 28 is less than half of the height "C" of the first and second lower sidewalls 30, 32. A width "E" of the base strip 28 is greater than a width "F" of the first or second lower openings 16, 18. The first and second edges of the lower strip 14 are bent at a substantially 90 degree angle relative to a middle portion of the lower strip 14 to form a U-shape. The first lower sidewall 30, the second lower sidewall 32 and a lower base portion 34 are formed from the bending.

Figure 2:
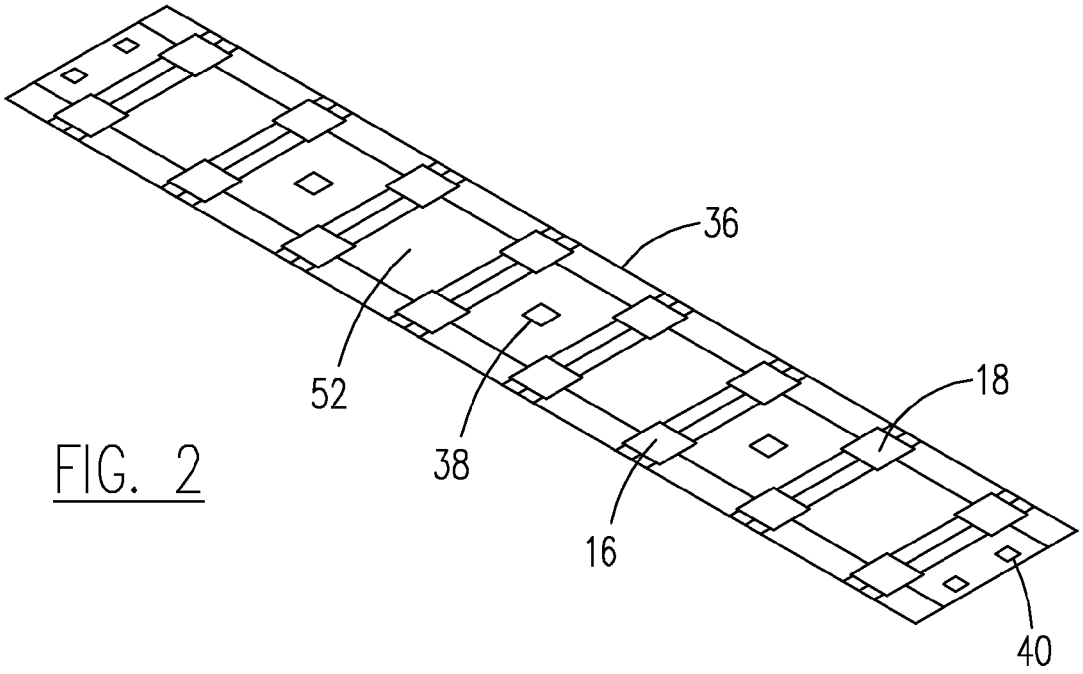
FIG. 2 is a perspective view of an unfolded upper member of a metal nailer with adjustable curvature in accordance with the present invention.

With reference to FIG. 2, the upper member 12 includes an upper strip of material 36. The upper member 12 includes all the features of the lower member 10, except that the lower fastener openings 20 are replaced with fastener clearance openings 38, 40 to allow a fastener to be installed with a tool. With reference to FIGS. 3-4, an upward bent fold 23 includes a first sidewall bent strip 42, a second sidewall bent strip 44 and a base bent strip 46. With reference to FIG. 6, a bent height "B" of the first and second upper sidewall bent strips 42, 44 is less than half of a height "C" of a first upper sidewall 48 and a second upper sidewall 50. A height "D" of the base bent strip 46 is less than half of the height "C" of the first and second upper sidewalls 48, 50. A width "E" of the base strip 46 is greater than a width of the first or second lower openings 16, 18. The first and second edges of the upper strip 36 are bent at a substantially 90 degree angle relative to a middle portion of the upper strip 36 to form a U-shape. The first upper sidewall 48, the second upper sidewall 50 and an upper base portion 52 are formed from the bending.

Figure 7:
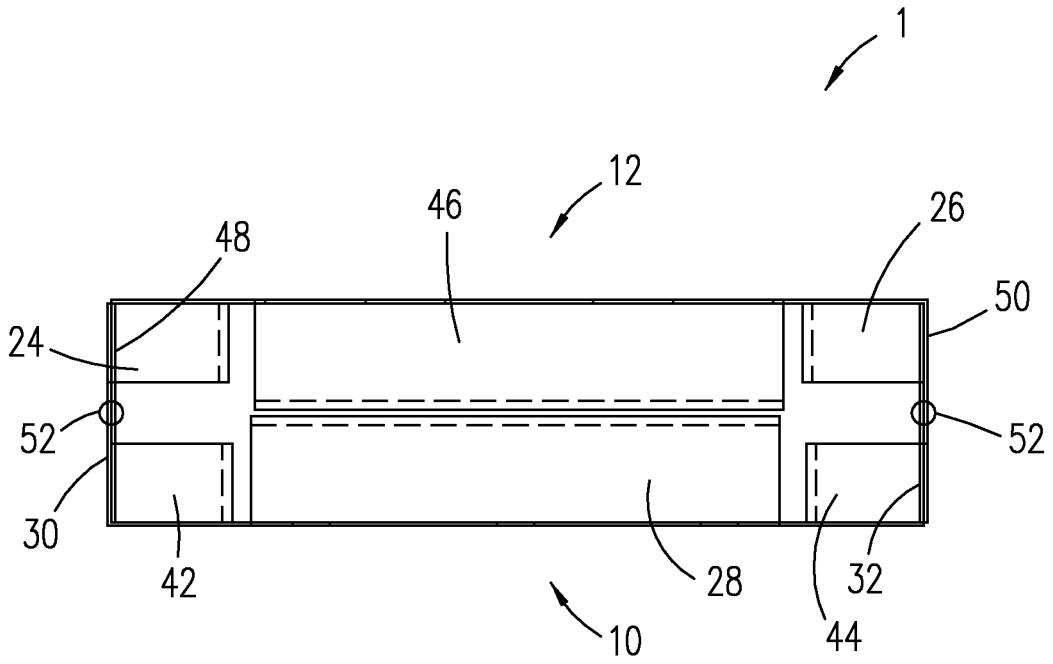
FIG. 7 is an end view of metal nailer with adjustable curvature in accordance with the present invention.
Figure 8:
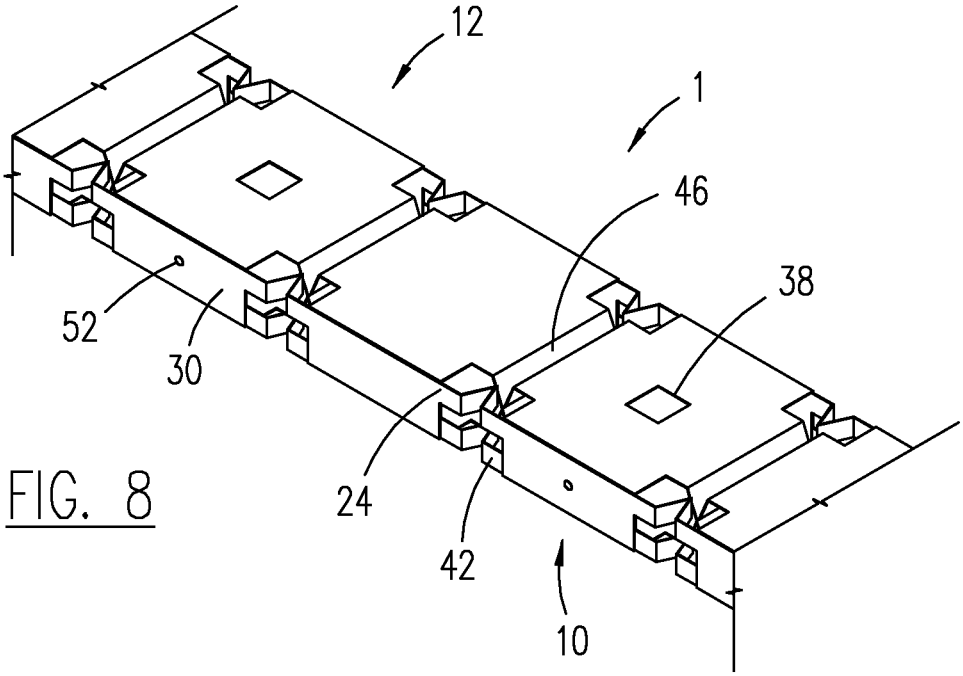
FIG. 8 is an enlarged partial perspective view of metal nailer with adjustable curvature, before bending in accordance with the present invention.

With reference to FIG. 7, the upper member 12 is inserted into the lower member 10, such that one of first and second upper sidewalls 48, 50 is inserted between the first and second lower sidewalls 30, 32 and moved horizontally, such that the first and second upper sidewalls 48, 50 contact the first and second lower sidewalls 30, 32. A plurality of fasteners 52, such as rivets or the like are used to secure the first upper sidewall 48 to the first lower sidewall 30 and the second lower sidewall 32 to the second upper sidewall 50. The upper member 12 allows fascia materials to be secured to a top surface thereof. FIGS. 8-9 show the metal nailer 1 in an unbent orientation.

Figure 10:
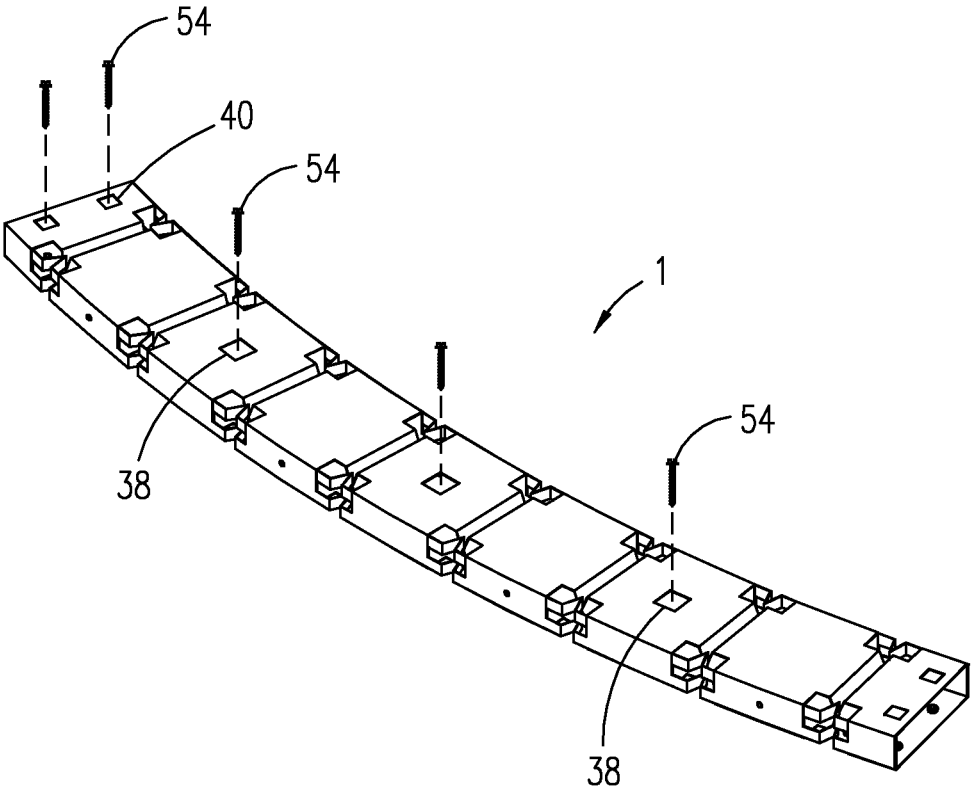
FIG. 10 is a perspective view of a metal nailer with adjustable curvature being bent in a horizontal plane in accordance with the present invention.
Figure 11:
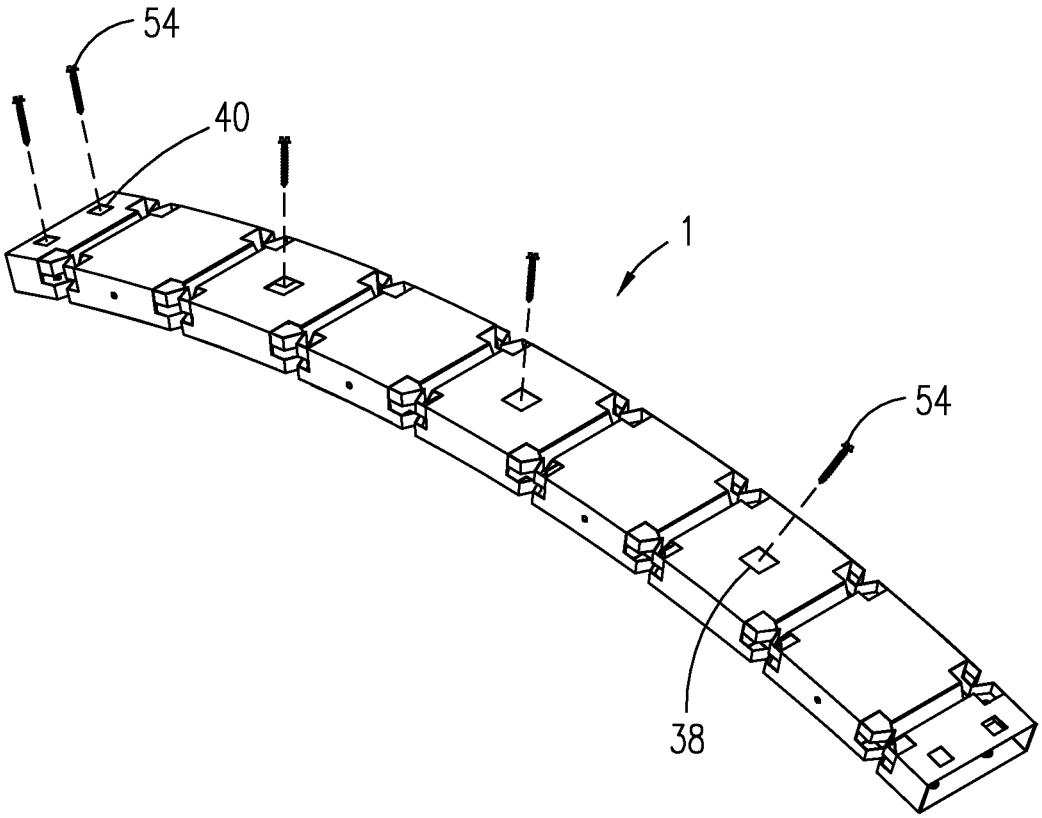
FIG. 11 is a perspective view of a metal nailer with adjustable curvature being bent in a vertical plane in accordance with the present invention.

With reference to FIGS. 10-11, the metal nailer 1 may be bent into a curved orientation in a horizontal plane, a vertical plane, or in both horizontal and vertical plates. The metal nailer is attached to a work surface by inserting a plurality of fasteners 54 through the plurality of lower fastener openings 38, 40 into a work surface. Bent strips 24, 26, 28, 42, 44 and 46 extend inward into the metal nailer with adjustable curvature 1.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A metal nailer with adjustable curvature, comprising:

an upper member includes a first upper sidewall having a first end and an opposite second end, a second upper sidewall having a first end and an opposite second end and an upper base portion interconnecting the second ends of the upper sidewalls, a plurality of first upper sidewall bent strips are formed in said first upper sidewall adjacent the first ends of the upper sidewalls, a plurality of second upper sidewall bent strips are formed in said second upper sidewall adjacent the first ends of the upper sidewalls, a plurality of upper base bent strips are formed in said upper base portion, a first upper opening is formed between each of said plurality of first upper sidewall bent strips and said plurality of upper base bent strips, a second upper opening is formed between each of said plurality of second upper sidewall bent strips and said plurality of upper base bent strips; and a lower member includes a first lower sidewall having a first end and an opposite second end, a second lower sidewall having a first end and an opposite second end and a lower base portion interconnecting the second ends of the lower sidewalls, a plurality of first lower sidewall bent strips are formed in said first lower sidewall adjacent the first ends of the lower sidewalls, a plurality of second lower sidewall bent strips are formed in said second lower sidewall adjacent the first ends of the lower sidewalls, a plurality of lower base bent strips are formed in said lower base portion, a first lower opening is formed between each of said plurality of first lower sidewall bent strips and said plurality of lower base bent strips, a second lower opening is formed between each of said plurality of second lower sidewall bent strips and said plurality of lower base bent strips, wherein said upper sidewall bent strips are configured to be moved within said first and second lower openings and said lower sidewall bent strips are configured to be moved within said first and second upper openings when the members are nested together.

2. The metal nailer with adjustable curvature of claim 1 wherein:

a length of said plurality of upper base bent strips is greater than a length of said first upper opening or said second upper opening; and a length of said plurality of lower base bent strips is greater than a length of said first lower opening or said second lower opening.

3. The metal nailer with adjustable curvature of claim 1 wherein:

a plurality of fastener openings are formed through said lower member, a plurality of fastener clearance openings are formed through said upper member.

4. The metal nailer with adjustable curvature of claim 1 wherein:

said first upper sidewall extends downward from a first edge of said upper base portion, said second upper sidewall extends downward from a second edge of said upper base portion, said first lower sidewall extends upward from a first edge of said lower base portion, said second lower sidewall extends upward from a second edge of said lower base portion.

5. The metal nailer with adjustable curvature of claim 1 wherein:

a height of said upper base bent strip is less than half of a height of said first or second upper sidewall, a height of said lower base bent strip is less than half of a height of said first or second lower sidewall.

6. The metal nailer with adjustable curvature of claim 1 wherein:

a bent height of said first or second upper sidewall bent strips is less than half of a height of said first or second upper sidewalls, a bent height of said first or second lower sidewall bent strips is less than half of a height of said first or second lower sidewalls.

7. The metal nailer with adjustable curvature of claim 1 wherein:

said upper bent strips and said lower bent strips extend inward into said metal nailer with adjustable curvature.

8. A metal nailer with adjustable curvature, comprising:

an upper member includes a first upper sidewall, a second upper sidewall and an upper base portion, a plurality of first upper sidewall bent strips are formed in said first upper sidewall, a plurality of second upper sidewall bent strips are formed in said second upper sidewall, a plurality of upper base bent strips are formed in said upper base portion, a first upper opening is formed between each of said plurality of first upper sidewall bent strips and said plurality of upper base bent strips, a second upper opening is formed between each of said plurality of second upper sidewall bent strips and said plurality of upper base bent strips, a width of said plurality of upper base bent strips is greater than a width of said plurality of first or second upper openings; and a lower member includes a first lower sidewall, a second lower sidewall and a lower base portion, a plurality of first lower sidewall bent strips are formed in said first lower sidewall, a plurality of second lower sidewall bent strips are formed in said second lower sidewall, a plurality of lower base bent strips are formed in said lower base portion, a first lower opening is formed between each of said plurality of first lower sidewall bent strips and said plurality of lower base bent strips, a second lower opening is formed between each of said plurality of second lower sidewall bent strips and said plurality of lower base bent strips, wherein said first upper sidewall is secured to said first lower sidewall, said second upper sidewall is secured to said second lower sidewall, said metal nailer is bendable in a vertical plane, a width of said plurality of lower base bent strips is greater than a width of said plurality of first or second lower openings.

9. The metal nailer with adjustable curvature of claim 8 wherein:

a length of said plurality of upper base bent strips is greater than a length of said first upper opening or said second upper opening; and a length of said plurality of lower base bent strips is greater than a length of said first lower opening or said second lower opening.

10. The metal nailer with adjustable curvature of claim 8 wherein:

a plurality of fastener openings are formed through said lower member, a plurality of fastener clearance openings are formed through said upper member.

11. The metal nailer with adjustable curvature of claim 8 wherein:

said first upper sidewall extends downward from a first edge of said upper base portion, said second upper sidewall extends downward from a second edge of said upper base portion, said first lower sidewall extends upward from a first edge of said lower base portion, said second lower sidewall extends upward from a second edge of said lower base portion.

12. The metal nailer with adjustable curvature of claim 8 wherein:

a height of said upper base bent strip is less than half of a height of said first or second upper sidewall, a height of said lower base bent strip is less than half of a height of said first or second lower sidewall.

13. The metal nailer with adjustable curvature of claim 8 wherein:

a bent height of said first or second upper sidewall bent strips is less than half of a height of said first or second upper sidewalls, a bent height of said first or second lower sidewall bent strips is less than half of a height of said first or second lower sidewalls.

14. The metal nailer with adjustable curvature of claim 8 wherein:

said upper bent strips and said lower bent strips extend inward into said metal nailer with adjustable curvature.

15. A metal nailer with adjustable curvature, comprising:

an upper member includes a first upper sidewall, a second upper sidewall and an upper base portion, a plurality of first upper sidewall bent strips are formed in said first upper sidewall, a plurality of second upper sidewall bent strips are formed in said second upper sidewall, a plurality of upper base bent strips are formed in said upper base portion, a first upper opening is formed between each of said plurality of first upper sidewall bent strips and said plurality of upper base bent strips, a second upper opening is formed between each of said plurality of second upper sidewall bent strips and said plurality of upper base bent strips; and a lower member includes a first lower sidewall, a second lower sidewall and a lower base portion, a plurality of first lower sidewall bent strips are formed in said first lower sidewall, a plurality of second lower sidewall bent strips are formed in said second lower sidewall, a plurality of lower base bent strips are formed in said lower base portion, a first lower opening is formed between each of said plurality of first lower sidewall bent strips and said plurality of lower base bent strips, a second lower opening is formed between each of said plurality of second lower sidewall bent strips and said plurality of lower base bent strips, wherein said first upper sidewall is secured to said first lower sidewall, said second upper sidewall is secured to said second lower sidewall, said metal nailer is bendable in a vertical plane or a horizontal plane, said plurality of first and second upper side wall bent strips do not contact said plurality of first and second lower side wall bent strips when said upper member is attached to said lower member.

16. The metal nailer with adjustable curvature of claim 15 wherein:

a length of said plurality of upper base bent strips is greater than a length of said first upper opening or said second upper opening; and a length of said plurality of lower base bent strips is greater than a length of said first lower opening or said second lower opening.

17. The metal nailer with adjustable curvature of claim 16 wherein:

a plurality of fastener openings are formed through said lower member, a plurality of fastener clearance openings are formed through said upper member.

18. The metal nailer with adjustable curvature of claim 15 wherein:

said first upper sidewall extends downward from a first edge of said upper base portion, said second upper sidewall extends downward from a second edge of said upper base portion, said first lower sidewall extends upward from a first edge of said lower base portion, said second lower sidewall extends upward from a second edge of said lower base portion.

19. The metal nailer with adjustable curvature of claim 15 wherein:

a height of said upper base bent strip is less than half of a height of said first or second upper sidewall, a height of said lower base bent strip is less than half of a height of said first or second lower sidewall.

20. The metal nailer with adjustable curvature of claim 15 wherein:

a bent height of said first or second upper sidewall bent strips is less than half of a height of said first or second upper sidewalls, a bent height of said first or second lower sidewall bent strips is less than half of a height of said first or second lower sidewalls.

* * * * *